US009254699B2

(12) United States Patent
Baxter

(10) Patent No.: US 9,254,699 B2
(45) Date of Patent: Feb. 9, 2016

(54) INKJET PRINTER CONTROL

(75) Inventor: William Ronald Stuart Baxter, Cambridge (GB)

(73) Assignee: Inca Digital Printers Limited (GB)

( * ) Notice: Subject to any disclaimer, the term of this patent is extended or adjusted under 35 U.S.C. 154(b) by 2114 days.

(21) Appl. No.: 11/990,132

(22) PCT Filed: Aug. 8, 2006

(86) PCT No.: PCT/GB2006/002942

§ 371 (c)(1),
(2), (4) Date: Mar. 17, 2008

(87) PCT Pub. No.: WO2007/017659

PCT Pub. Date: Feb. 15, 2007

(65) Prior Publication Data

US 2009/0256881 A1 Oct. 15, 2009

(30) Foreign Application Priority Data

Aug. 8, 2005 (GB) ..... 0516301.9

(51) Int. Cl.
*B41J 29/393* (2006.01)
*B41J 2/175* (2006.01)
*B41J 2/045* (2006.01)

(52) U.S. Cl.
CPC ..... *B41J 29/393* (2013.01); *B41J 2/175* (2013.01); *B41J 2/0458* (2013.01)

(58) Field of Classification Search
CPC ..... B41J 29/393; B41J 2/175; B41J 2/0458
USPC ..... 347/19, 6, 5
See application file for complete search history.

(56) References Cited

U.S. PATENT DOCUMENTS 5,349,905 A 9/1994 Taylor et al.
5,714,990 A 2/1998 Courtney (Continued)

FOREIGN PATENT DOCUMENTS

EP 0 720 914 A2 7/1996
EP 0 753 832 A2 1/1997

(Continued)

OTHER PUBLICATIONS

International Search Report for PCT/GB2006/002942, dated Nov. 8, 2006.

(Continued)

*Primary Examiner* — Henok Legesse
(74) *Attorney, Agent, or Firm* — Lerner, David, Littenberg, Krumholz & Mentlik, LLP

(57) ABSTRACT

A printing speed for printing an image using an inkjet printer is determined. Information regarding a measure of the nozzle firing quality of the printer as a function of printing speed and in relation to an image attribute is determined. The image to be printed is analyzed in respect of the image attribute and the information regarding the measure of the nozzle firing quality is used to determine an optimum printing speed for printing the image. Thus a determination may be made as to how fast a particular image may be printed using a particular printer arrangement without unacceptable loss of print quality of the image. Also described is a method of determining printing instructions for printing a plurality of images in which a printing speed for each image is determined, and printing instructions for printing the plurality of images is determined so as to increase the overall efficiency of printing the plurality of images.

25 Claims, 4 Drawing Sheets

(56) References Cited

U.S. PATENT DOCUMENTS

| | | | | |
|---|---|---|---|---|
| 5,719,602 | A | 2/1998 | Hackleman et al. | |
| 6,012,792 | A | 1/2000 | Sievert et al. | |
| 6,217,150 | B1 | 4/2001 | Heydinger | |
| 6,452,618 | B1 | 9/2002 | Heim | |
| 6,971,731 | B2 * | 12/2005 | Brenner et al. | 347/14 |
| 2002/0135631 | A1 * | 9/2002 | Sasaki et al. | 347/19 |
| 2003/0081037 | A1 * | 5/2003 | Gaston et al. | 347/19 |
| 2004/0113964 | A1 | 6/2004 | Booth et al. | |
| 2005/0219283 | A1 | 10/2005 | Kachi | |

FOREIGN PATENT DOCUMENTS

| | | | |
|---|---|---|---|
| EP | 0 753 832 | A3 | 1/1997 |
| EP | 0 894 639 | A1 | 2/1999 |
| EP | 1 168 245 | A2 | 1/2002 |
| EP | 1 170 693 | A2 | 1/2002 |
| EP | 1 170 693 | A3 | 1/2002 |
| EP | 1 682 45 | A3 | 1/2002 |
| JP | 3-247450 | | 11/1991 |
| JP | 06238969 | | 8/1994 |
| JP | 08230178 | | 9/1996 |
| JP | 11179893 | | 7/1999 |
| JP | 2001162828 | A | 6/2001 |
| JP | 2001171098 | A | 6/2001 |
| JP | 2001239657 | A | 9/2001 |
| JP | 2002067445 | A | 3/2002 |
| JP | 2003159793 | A | 6/2003 |
| JP | 2005022305 | A | 1/2005 |
| WO | WO-00/76773 | A1 | 12/2000 |

OTHER PUBLICATIONS

Written Opinion for PCT/GB2006/002942.
British Search Report for GB 0516301.9.
International Preliminary Report on Patentability for PCT/GB2006/002942 mailed Feb. 21, 2008.
Japanese Office Action for Application No. 2008-525621 dated Jan. 29, 2013.
Instructions response to Japanese Office Action dated Mar. 27, 2013.
Letter from Japanese attorney for Japanese Patent Application No. 2008-525621 dated Apr. 22, 2013.
Further instructions for Japanese Patent Application No. 2008-525621 dated Apr. 23, 2013.
Response as filed for Japanese Application No. 2008-525621 dated May 2013.
Claims as Granted JP5451070.
Claims as Granted JP5451070 changes from PCT Claims.
Certificate of Grant Patent No. 5451070 for Japanese Application No. 2008-525621 dated Jan. 10, 2014.
Grant Decision for Japanese Application No. 2008-525621 dated Dec. 2013.

* cited by examiner

Normalised speed at 80% fill, 0.2m scale

Extrapolated limit
speed at 80% fill, 0.2m scale
Length of run without deterioration Normalised speed ratio
80% fill
60% fill
40% fill
Recovery
length scale Length scale

INKJET PRINTER CONTROL

This invention relates to inkjet printing. The invention finds particular, but not exclusive, application to drop-on-demand inkjet printing.

In an inkjet printing process, an array of droplets of, for example, ink is deposited onto the surface of a substrate in a pattern to form the required image. The droplets of ink are typically emitted from an array of nozzles of an inkjet printhead. A typical printer includes several printheads arranged in a printhead array. It is generally necessary for there to be relative movement between the printhead array and the substrate during the printing procedure for the whole of the required image to be printed onto the substrate.

The speed of relative movement of the printhead and the substrate and thus the linear speed of printing at which images can be printed using an inkjet printer is limited by a number of factors. In particular, the speed is limited by the speed at which the printhead nozzles can fire the ink droplets towards the substrate.

An absolute upper limit on the speed of printing tends to be set by acoustics within the printhead, but in practice there are other factors that set a practical limit of the printing speed that is typically significantly lower then the absolute limit.

As the firing frequency is increased, it is often found that the printing starts to become less reliable, and thus image quality can be reduced. This reduction in reliability can be due to a combination of factors such as the acoustics of the ink meniscus and build-up of ink on the nozzle plates of the printhead due to splash-back of the emitted ink onto the nozzle plate or satellite droplets being formed and impacting on the nozzle plate.

Thus a key factor relating to the print quality of the printed image is the "nozzle firing quality". This preferably includes, for example, the regularity and straightness with which the nozzles eject droplets of, for example, ink.

An important factor that may be taken into account in determining the nozzle firing quality, in addition or alternatively to those set out above, is the consistency of the print quality over a large number of consecutive, continuously produced, prints, which may be termed the nozzle firing reliability. Typically the nozzles all start out in full functioning order, and may print as intended for the first ten/hundred images, then nozzles start to be lost.

In practice, an acceptable firing frequency and thus printing speed is often determined for a particular printer arrangement by determining a speed at which an acceptable print quality can be obtained for a solid fill image.

There would be an advantage in being able to obtain a higher speed of printing without unacceptable reduction in the quality of a printed image throughout a print run of multiple prints of that image.

According to a first aspect of the invention, there is provided a method of determining a printing speed for printing an image using an inkjet printer, the method comprising the steps of: determining information regarding a measure of the nozzle firing quality for the printer as a function of printing speed and in relation to an image attribute, analysing the image to be printed in respect of the image attribute, and using the information regarding the a measure of the nozzle firing quality for the printer to determine an optimum printing speed for printing the image.

In this way, a determination can be made as to how fast a particular image or set of images may be printed using a particular printer arrangement without unacceptable loss of print quality of the image. By assessing the relevant speed of printing having regard to the actual image to be printed, efficiencies can be made since some images can be printed relatively quickly without unacceptable loss in print quality. In preferred examples described herein, such relevant speed can be identified by analysing the image in respect of an image attribute and, in some embodiments, a plurality of image attributes.

The method may include the step of determining the information regarding nozzle firing quality in respect of a printer arrangement to be used to print the image. In some embodiments, alternative or additional printer attributes may be used other than or in addition to the measure of the nozzle firing quality.

In one embodiment, the optimum printing speed may comprise the maximum printing speed for printing the image.

Preferably, the information regarding a measure of the nozzle firing quality is specific to an actual or type of printer arrangement to be used to print the image. In some cases, the actual printer arrangement to be used to print the image is analysed before the image is printed. By using information specific to a printing arrangement similar to or the same as the one to be used to carry out the printing, a more accurate determination of an optimum printing speed can be made. For example the determination can take into account several variables of the printer arrangement, such as the type of ink being used in the printer arrangement.

In other examples, the information may be specific to the printheads being used to print the image. Different types of printheads have different printing performance.

Preferably the predetermined information is derived experimentally, preferably using a printer arrangement similar to or the same as that to be used to print the image. By using experiment to determine the information, many variables relating to the printer arrangement can be taken into account.

Preferably the information regarding the measure of the nozzle firing quality includes information regarding a printing speed for printing a substantially full fill image. Preferably the information relates to the optimum printing speed, which preferably relates to the maximum printing speed possible while maintaining acceptable print quality. Preferably the substantially full fill image comprises a 100% fill image.

Where reference is made to 100% fill for a printed image, in many cases, this preferably refers to the nozzles printing at every grid point. However, in some cases, it may be advantageous to operate the printer so that not every grid point is printed even for 100% fill. In some cases it is advantageous to drive the printhead at a high apparent data rate, but not print at every grid point. FIG. 1 shows an example of such a method in which the grid pattern is varied in the print direction by driving the printhead at a high data rate, but printing on fewer than every grid point 2 (shown at the intersection of the grid lines): the actual fill is less than the maximum possible fill. FIG. 1 shows an example in which a 100% fill pattern of droplets 1 is achieved. There is a pseudo-random variation in the drop placement in the print direction; such patterns can help to break up visual artefacts due to regular drop placement patterns. In FIG. 1, the separation of droplets is varied in order to remove visual artefacts from the printing. The separation varies between four and six grid points; the average separation is five. In the case shown in FIG. 1, the maximum frequency of drop ejection (the "firing frequency" is V/4G where V is the relative velocity of the printhead and the substrate in mm per second and G is the grid pitch in the print direction in mm. The factor 4 appears in the formula because the minimum pitch 3 is four grid points, so that the minimum interval between two drops is 4G grid pitches.

Thus it is to be understood that where reference is made to 100% fill it is preferably a reference to producing the most solid fill of that particular printer set up. In many cases, this will be printing at every grid point by the nozzles; in other cases, such as that described above, this may be printing at fewer than all grid points. Preferably, 100% fill represents the greatest amount of fill actually used, averaged over any pseudo-random variation, for example that shown in FIG. 1.

Preferably the information regarding nozzle firing quality includes information relating to optimum printing speed for printing an image having less than full fill. The effect on nozzle firing reliability of the fill ratio for the image or part of image to be printed is preferably determined and used in the determination of optimum printing speed.

Preferably, the predetermined information includes information regarding an optimum printing speed for printing images having a range of different percentage fill. From this information, if information regarding the % fill is then obtained for the image to be printed, the optimum speed for printing the image can be extrapolated from this information.

Preferably the information regarding nozzle firing quality includes information relating to a plurality of different average nozzle utilization measures for the nozzles or a plurality of different values for an average measure of nozzle utilization for the nozzles. Preferably the information relates to a plurality of different average nozzle utilization measures.

The nozzle utilization measure is preferably related to the % fill. Preferably the measures are directly related. For example, 100% nozzle utilization preferably corresponds to 100% fill; 50% nozzle utilization corresponds to 50% fill, and so on. The nozzle utilization is preferably linearly related to the % fill, but there may be a non-linear relationship in some embodiments or at high or low % fill. In some embodiments, the nozzle utilization measure may be termed the "duty cycle".

In preferred examples, information is obtained regarding the optimum printing speed for different average measures of nozzle utilisation for the nozzles or a plurality of different values for an average measure of nozzle utilization for the nozzles. From this information, where information regarding the average nozzle utilization measure for the image to be printed has been obtained, the optimum speed for printing the image can be extrapolated.

In many cases, the optimum speed can be taken as being inversely proportional to the average nozzle utilization measure up to a limit caused by other factors, for example limitations of the transport system or the effects of wind shear affecting the break-up of droplets.

Preferably the step of determining information regarding a measure of the nozzle firing quality for the printer includes printing a test image at a plurality of different printing speeds. The test image has particular printer attribute measure, such as a measure of the nozzle utilization, and, by printing at different speeds, assessment of the maximum speed for printing the test image can be determined for achieving a particular nozzle firing quality.

Where the test image has a particular image attribute or set of image attributes, therefore, a maximum speed for printing images having such attributes can be determined that allows nozzle firing quality to be maintained.

For example the test image may require a particular average nozzle utilization of the nozzles used to print the image, and/or a particular pattern of high nozzle utilization and low nozzle utilization.

Preferably the method includes printing a further test image at a plurality of different printing speeds. In this way, information regarding preferred printing speeds for images having a range of different attributes can be determined.

Preferably the method further comprises determining a print recovery length. Preferably the print recovery length comprises a length of image over which the optimum speed for good nozzle firing reliability can be predicted from the average % fill over the image, even if the image itself is made up of (for instance) a checkerboard pattern of high and low % fill. The print recovery length may be a function of, for instance, average % fill.

A measure of the length of printing over which the distribution of droplets for a particular measure of nozzle utilization has no substantial effect on the nozzle firing quality may also be determined. This information can be used to simplify the analysis of subsequent images to be printed.

The information is preferably obtained in respect of the actual printer configuration, settings and inks to be used. The information may also include information regarding substrate speed, printhead drive waveforms and other variables.

As discussed above in relation to analysis of the image, by obtaining information regarding more variables of the printer arrangement and attributes of the image, a more detailed assessment of optimum printing speed can be made, if desired.

Preferably the method includes the step of analysing image data to determine features of the image with regard to the image attribute, but the method may include the step of analysing an actual image. That is, either data relating to an image, or a printed image itself may be analysed.

Preferably the method includes identifying information relating to the print density of the image to be printed. By analysing the image to be printed, it is possible to make an assessment of, for example, the proportion of grid points to be printed for that image, and hence the nozzle utilization required of particular nozzles to print the image.

In some examples, where the proportion of grid points to be printed for the image is relatively low, a significant improvement in printing efficiency may be made as described below.

In simple terms, the speed at which an image can be printed is a function of the maximum rate at which the nozzles of a printhead fire.

It is found that, even at high print speeds, the nozzle reliability can be maintained if the images printed are of low "nozzle utilization": if the proportion of grid points at which the nozzles actually fire is low. In such cases, the actual density of printing is much less than that needed to produce a solid fill of colour (for example the 100% fill shown in FIG. 1). Roughly speaking, an image that is 80% the density of a solid fill might be run at about 25% above the frequency for solid fill, which means that the substrate can be run at a 25% higher speed leading to significant efficiency savings and in particular to significant improvements in throughput.

Preferably the method includes identifying information relating to the proportion of grid points to be printed. This information can give an indication of the print density of the image and also of the nozzle utilization for the nozzles to be used in printing the image. By subsequently using information relating to the relationship between speed of printing, the nozzle utilization for the image and the print quality, a useful determination of printing speed for the image can be made.

Preferably the method includes determining the nozzle utilization required for a nozzle to print the image. In this way, the nozzle utilization required in respect of parts of the image to be printed, for example using different nozzles, printheads and different inks can be identified. Thus, where there is a difference in printing reliability or performance between these different nozzles, printheads or inks, this can be taken into account when determining the optimum printing speed.

For example, for any given image, some nozzles will have to do more printing than others. The maximum run speed for the print may therefore be set by the more heavily-used nozzles. Statistics may also be taken into account, for example, if a single nozzle is heavily loaded and the rest very lightly loaded, the maximum run speed may be set higher than it would be if all the nozzles were at the high loading.

For an image to be printed using a usual four-colour CMYK ink system, groups of nozzles will be arranged to print using the different coloured inks.

Preferably the method includes analysing each colour of the image to be printed. By analysing each colour, a better assessment of the maximum speed for printing can be made. For example, if is known that print quality deteriorates quickly at high speeds for an image including much printing using black ink then this can be taken into account when an assessment of the image to be printed determines that it includes a large amount of black ink.

In preferred examples, the average nozzle utilization for each colour is determined. However, other analyses may be carried out alternatively or in addition. For example, the average nozzle utilization, or maximum nozzle utilization can be determined for each colour, or each printhead, or even for each nozzle. As further discussed below, information relating to the relationship between print quality and those variables at different printing speeds is then used to determine an optimum printing speed for printing that particular image (or type of image).

Further, analysis of the firing sequence for the nozzles to be used in printing the image can be carried out. For example, the frequency of firing the nozzle and the number of consecutive droplets to be fired by the nozzle can be determined. It is noted that in some cases, the nozzles of a printhead can be fired reliably at high frequency for a short time, after which print quality can deteriorate.

Preferably sections of the image are analysed separately, wherein the print length of the section is not more than the print recovery length. In this way a simplified analysis may be used, for example considering only the average nozzle utilization over the print length, and not the distribution of droplets to be printed within the length.

Preferably a single print speed is determined in respect of the printing of the image. Whereas it is envisaged that different print speeds could be used to print different parts of the image, or to print using the different colours of the image, for efficiency a single optimum print speed is determined for the whole image.

Preferably the method includes analysing a plurality of images to be printed; and using the information to determine printing instructions for printing the plurality of images.

Preferably the images of the plurality of images are different. Preferably the method includes determining a printing speed for each of the images to be printed, and determining printing instructions for printing the plurality of images to increase the overall efficiency of printing the plurality of images.

Preferably, determining printing instructions comprises determining a printing order or schedule for the images to reduce changes in speed from one image to the next during printing the images. Preferably the images are reordered to reduce the amount and/or number of times the printing speed needs to be changed during printing of the group of images.

In some cases, adjustments may be made to the printing speed to reduce the number of speed changes required. Generally, print speeds would be reduced so that print quality was not sacrificed.

A broad aspect of the invention provides a method of determining printing speed for printing a plurality of images, the method comprising the step of: determining a printing speed for printing each image; and determining printing instructions for printing the plurality of images to increase the overall efficiency of printing the plurality of images.

Preferably, determining printing instructions comprises determining instructions for printing the images to reduce changes in the printing speed between the printing of images. For example, the images can be ordered to minimize changes in speed, for example the number of changes and/or the size of changes in speed. Alternatively, or in addition, a printing speed for one or more of the images may be changed. For example, the printing speed may be changed to be closer to the determined speed for a preceding or following image.

Preferably the changes in speed occur between the printing of separate images, and not during printing of an image.

Preferably, the step of determining a printing speed for each image includes determining an optimum printing speed for each separate image, preferably using a method described herein.

Preferably, the printing speed is determined based on an attribute of the image. Further preferably, the printing speed may be determined based on an attribute of the printer.

In one embodiment, the printing speed may be determined based on a measure of the nozzle firing quality.

In a further preferred embodiment, the printing speed is determined based on information relating to the print density of the image.

A further aspect of the invention provides a method of determining a printing speed for printing an image using an inkjet printer, the method comprising the steps of: analysing the image to be printed in respect of an image attribute, and using predetermined information regarding the nozzle firing quality for the printer as a function of printing speed and the image attribute, to determine a printing speed for printing the image.

In a broad aspect of the invention there is provided a method of determining a printing speed for printing an image using an inkjet printer, the method comprising the steps of: analysing the image to be printed in respect of an image attribute, and using predetermined information regarding a measure of the nozzle firing quality for the printer as a function of printing speed and the image attribute, to determine a printing speed for printing the image. Thus the running of the print job can be determined on the basis of the information identified in relation to the image to be printed.

The information used to determine the running of the print job is preferably based on analysis and preferably relates to the relationship between factors associated with the firing of the print nozzles and print quality. The speed of firing the nozzles and also length of time printing at that speed of nozzle firing can be important to consider.

Preferably the method further comprises the step of printing the image. Preferably the printheads are substantially stationary during the printing of the image. Preferably the image is printed in a single pass of the substrate relative to the printheads.

The invention also provides apparatus for carrying out a method described herein.

A further aspect of the invention provides an apparatus for determining a printing speed for printing an image using an inkjet printer, the apparatus comprising: means for analysing the image to be printed in respect of an image attribute, and means for using predetermined information regarding a measure of the nozzle firing quality for the printer as a function of printing speed and the image attribute, to determine an optimum printing speed for printing the image.

In one embodiment, the optimum printing speed may comprise a maximum speed for printing the image.

Also provided by the invention is an apparatus for determining a printing speed for printing an image using an inkjet printer, the apparatus comprising: an input for receiving information regarding an image attribute of an image to be printed, a storage device for storing information regarding a measure of the nozzle firing quality for the printer as a function of printing speed and the image attribute, and a processor adapted to use the image information and nozzle firing quality information in determining a printing speed for printing the image.

A further aspect of the invention provides an inkjet printer including means for determining the printing speed as described herein, and further including a printhead arranged to print an image on a substrate at the determined print speed.

Also provided by an aspect of the invention is a method of analysing a printer to determine information regarding the nozzle firing quality for the printer as a function of printing speed and an image attribute, the method including the steps of: printing a test image using the printer at a plurality of printing speeds; and analysing the printed test images to determine the maximum printing speed for the printer to print the test image having a desirable nozzle firing quality.

In preferred examples, the assessment of the maximum speed to produce the desired nozzle firing quality is carried out by visual inspection of the printed image, but it is envisaged that apparatus could be used to carry out the assessment. The test images printed preferably include a solid fill or 100% nozzle utilization image and images printed at different nozzle utilizations.

Preferably the method further includes the step of printing an image including regions of solid fill and unprinted regions at a plurality of printing speeds. In this way, the effect of nozzle utilization on nozzle firing reliability and thus print quality can be assessed, and thus a maximum printing speed and recovery length for different nozzle utilizations can be determined.

The invention further provides a substrate printed using a printer as described herein and/or using a method as described herein.

The invention also provides a computer program and a computer program product for carrying out any of the methods described herein and/or for embodying any of the apparatus features described herein, and a computer readable medium having stored thereon a program for carrying out any of the methods described herein and/or for embodying any of the apparatus features described herein.

The invention also provides a signal embodying a computer program for carrying out any of the methods described herein and/or for embodying any of the apparatus features described herein, a method of transmitting such a signal, and a computer product having an operating system which supports a computer program for carrying out any of the methods described herein and/or for embodying any of the apparatus features described herein.

Further aspects of the invention provide an apparatus being substantially as described herein having reference to and as illustrated in the accompanying figures and a method being substantially as described herein having reference to the accompanying figures.

Features of one aspect of the invention may be provided with features of other aspects in any appropriate combination.

Furthermore, features implemented in hardware may generally be implemented in software, and vice versa. Any reference to software and hardware features herein should be construed accordingly.

Preferred features of the present invention will now be described, purely by way of example, with reference to the accompanying drawings, in which.

Figure 5A:
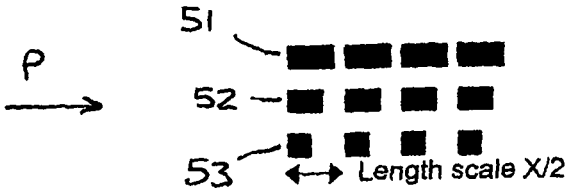
Figure 5B:
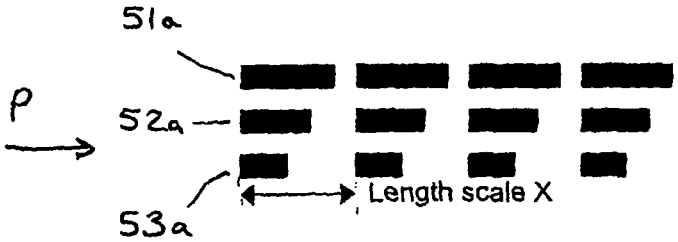
Figure 6:
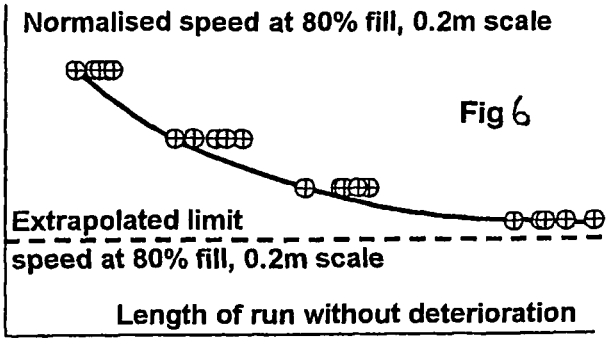
Figure 7:
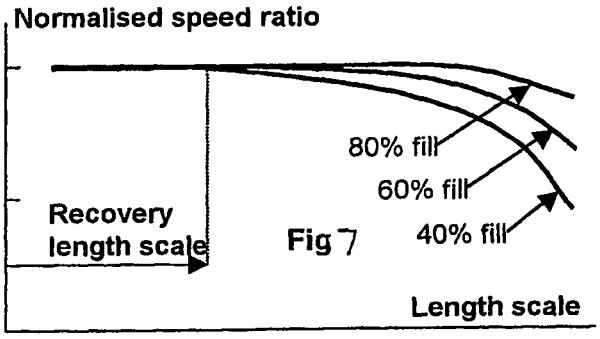

FIGS. 5*a* and 5*b* show schematically patterns to be printed to analyse the printer arrangement;

FIG. 6 shows a graph of normalised printing speed against maximum length of run without deterioration; and FIG. 7 shows "normalised speed ratio" against length scale for printed patterns of the type shown in FIGS. 5*a* and 5*b*.

The following describes examples of characterising an inkjet printer to be used to print images and then analysing an image to be printed using the inkjet printer and determining a speed of printing for printing of the image using the printer to obtain the desired print quality at an efficient printing speed.

In summary, for an inkjet printer to be used to print an image, it is possible to determine a desired maximum speed of printing for images to be printed on the basis of the nozzle firing quality, or reliability of accurate firing by the nozzles of the printhead. Then, for an image to be printed using the inkjet printer, it is possible to determine attributes of the image such as average nozzle utilization for the nozzles and then to select a print speed such that the maximum throughput is obtained for efficient printing while maintaining the desired level of nozzle firing quality. For example, if the image is one including a large amount of solid fill, it may be determined that the print speed cannot be increased above a minimum print speed if nozzle firing quality and print quality is to be maintained. Many images, however, are quite sparse, with large areas of blank space and other areas of light coverage. Such images provide an opportunity to increase the print speed and hence the output of the printer.

The steps include:

- Analyse the printer to characterise the print quality with regard to nozzle firing quality as a function of variables and image attributes for that printer or type of printer
- Analyse the image to be printed in terms of the attributes
- Determine the print speed for printing of the image to maximise output of the printer for a particular nozzle firing quality and thus print quality.

Analysis of Printer

As a first step, the printer arrangement to be used to print the image is analysed. In this step, the relationship between nozzle firing quality and the nature of the image to be printed is determined.

The key variables which depend on the nature of the image to be printed include the frequency of firing of the nozzles of the printheads, the average nozzle utilization for each nozzle and the maximum period of 100% nozzle utilization printing achievable for each nozzle. It will be appreciated that other variables related to the firing of the printhead nozzles will also be relevant.

The relationship of these key variables and nozzle firing quality and print quality will generally depend on other variables associated with the printer to be used to print the image. These other variables include the type of printer used, the ink used, the speed of the substrate onto which the image is to be printed and the type of printheads used as well as operating conditions, for example voltage and waveform used to fire the printheads, and temperature of printing. It will be appreciated that other factors will also be relevant.

In a preferred example, the key variables are analysed by experiment using the type of printer set-up to be used in the printing of the image. In practice, this may be the actual set-up to be used, or may be carried out, for example, for a similar type of printer/printhead arrangement.

The reliability of nozzle jetting as a function of the key variables is analysed using several tests. These tests can be, for example, used to determine the maximum speed of printing using the printing set-up to print a 100% fill image (this then relates to the minimum speed which will be used to print subsequent images), and also to determine the relationship between the speed of printing and nozzle firing quality for different nozzle utilizations.

Figure 1:
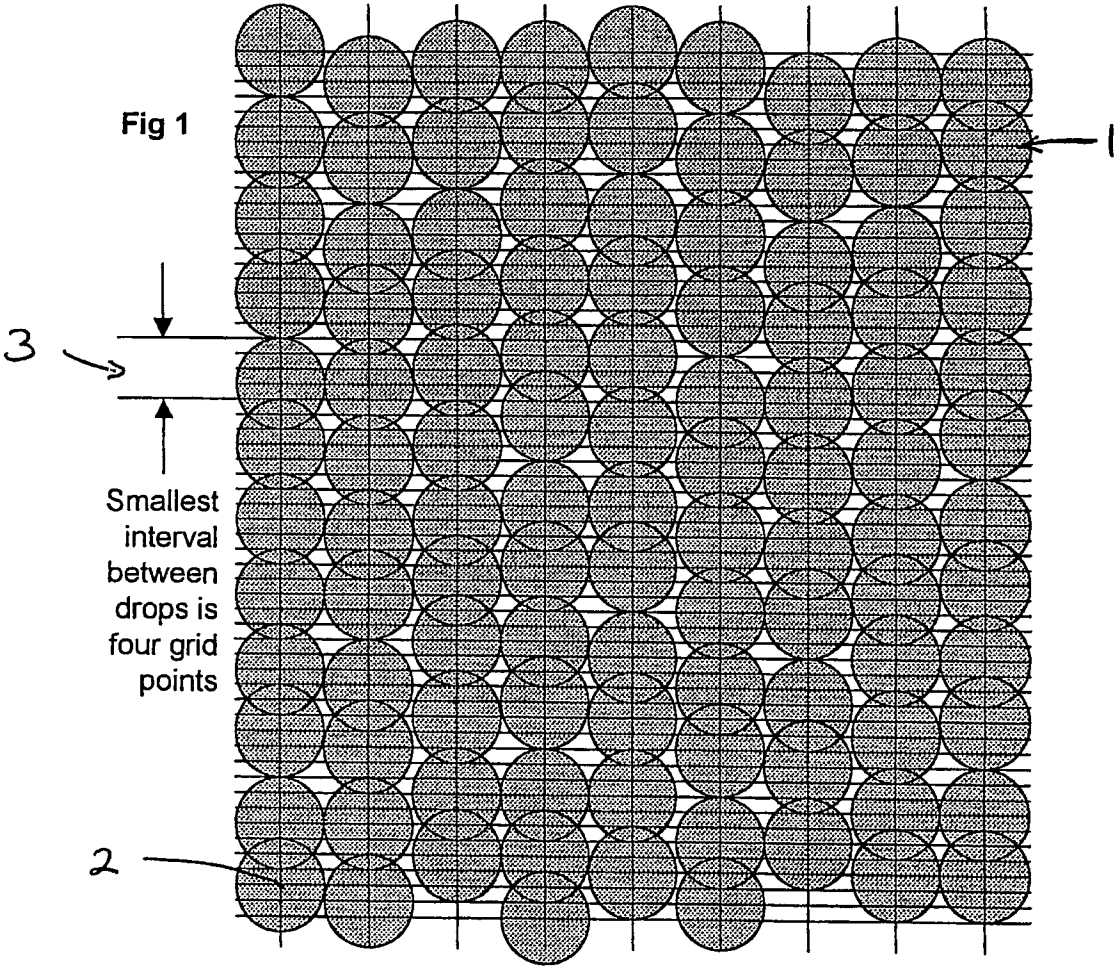
FIG. 1 shows schematically a pattern of printed droplets.
Figure 2:
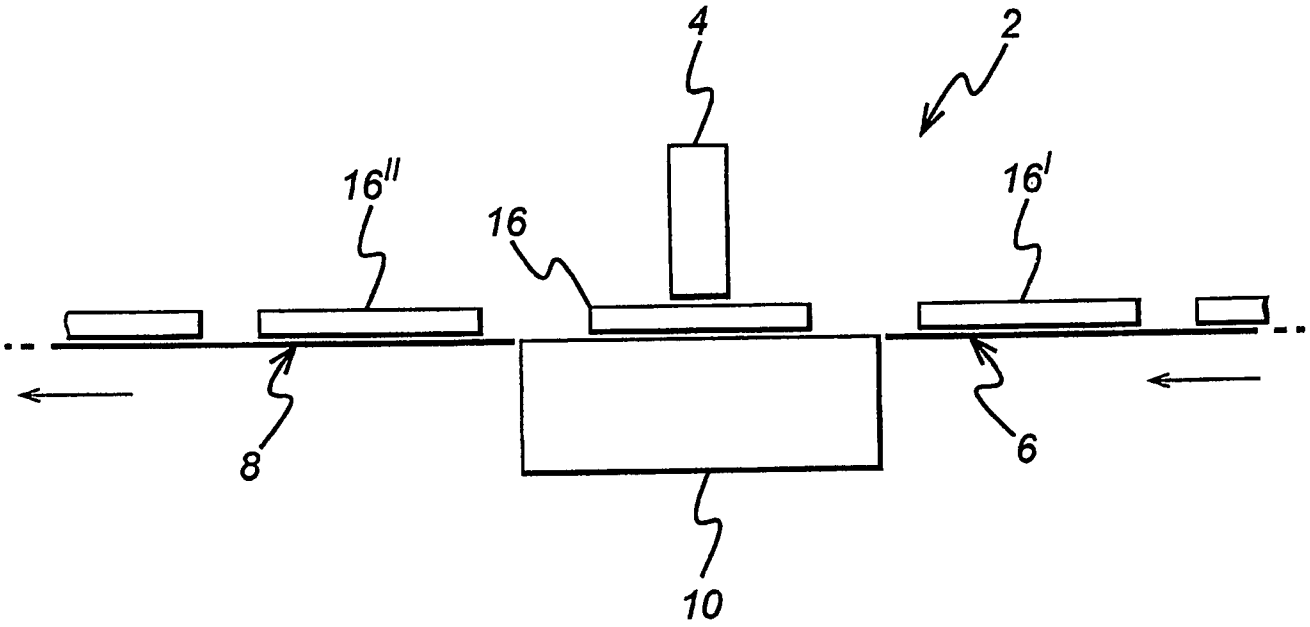
FIG. 2 shows schematically a printer arrangement.

FIG. 2 shows an example of a printer arrangement used for the analysis. In the printer 2 of FIG. 2, an array of printheads 4 is mounted on a frame. A series of conveyors 6, 10, 8 is mounted under the printheads 4 and substrates 16, 16', 16" to be printed are loaded onto the first conveyor 6 and are moved under the printheads 4 during printing by a second conveyor 10 before being transferred to a third conveyor 8. In this arrangement, the printheads 4 do not move during the printing of the substrate 16; the image is printed during a single pass of the substrate 16 under the printheads 4. In this arrangement, the printheads in the printhead array are 4-colour CMYK printheads and are used to print a full-colour image onto the substrate 16. The substrates 16 comprise discrete sheets of, for example, card which are fed onto the conveyor 6 in a known way.

Step 1: Determination of Maximum Printing Speed for Solid Fill

In a first series of tests, the printer arrangement of FIG. 2 is used to print solid (100%) fill images. This first series of tests therefore analyses the printhead nozzles running at full nozzle utilization; the nozzles fire at each grid point in this example but, as explained above, in some embodiments, a solid fill image may not require every grid point to be printed.

For each colour, a solid fill image is printed using the inkjet printer at various different printing speeds. During the printing of the image, each nozzle prints at full nozzle utilization, with the frequency of the emission of droplets by the nozzles depending on the printing speed.

Four separate groups of tests are carried out in this series:

1. 100% cyan image. The nozzles for cyan ink all fire at each grid point
2. 100% magenta image. The nozzles for magenta ink all fire at each grid point
3. 100% yellow image. The nozzles for yellow ink all fire at each grid point
4. 100% black image. The nozzles for black ink all fire at each grid point If desired, a further test may be carried out in which a solid fill four-colour image is printed, in which each nozzle of the CMYK printhead fires at each grid point of the image to be printed. This represents the printheads working at maximum capacity and may used to analyse whether there is, for example, crosstalk between the nozzles of different colours.

It is preferred for the tests to be carried out individually for each colour since the ink used for each colour will be different and therefore there are expected to be variations in printing performance between the different colours of ink. However, it is possible for reasonable results to be obtained by only carrying out a single test for the full colour image.

Further tests could be carried out, for example to print the various possible two-colour and three-colour images.

The test images are printed using different printing speeds: the relative movement of the substrate and the printheads, and the frequency of firing of the nozzles is varied.

The test images printed in these tests are analysed visually to identify defects in the printed images. In particular, the distance of printing in the print direction (run length) before the firing of the nozzles becomes unreliable is measured. Typically five print runs for each printing speed tests are carried out since there is likely to be some statistical variation between the runs. The lowest figure for the run length is taken from these repeat runs.

Figure 3:
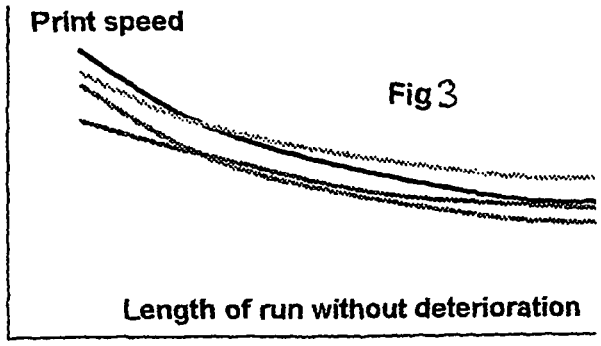
FIG. 3 shows a graph of print speed against maximum length of run without deterioration.

The run length without nozzle firing quality deterioration is then plotted against the printing speed to give a graph, an example of which is shown in FIG. 3. Print speed against length of run without deterioration is plotted for each colour. FIG. 3 shows a graph for a four-colour inkjet printer, and shows that the different inks have different characteristics.

In the present example, where the substrates 16 comprise discrete sheets, there will generally be a gap between adjacent substrates to be printed. Thus, even for a "continuous" print run where the substrates are printed continuously, there will be gaps in the printing between the substrates. The printheads will usually not emit ink into the gaps between the substrates. These gaps are, in this example, accepted as an inevitable part of the "continuous" print run. In some cases, where a different size substrate is to be used in subsequent printing operations, the solid fill tests could be repeated for these different sized substrates, if desired.

Figure 4:
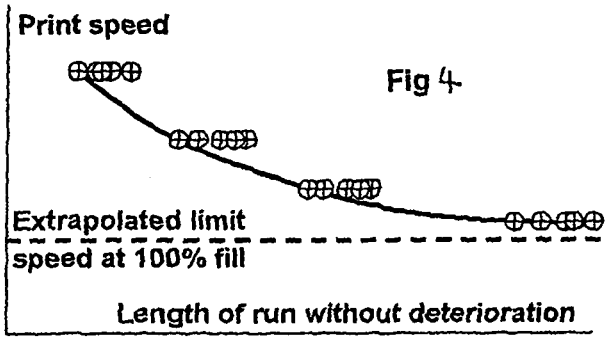
FIG. 4 shows a graph including an extrapolated maximum print speed.

To determine the maximum acceptable continuous printing speed for solid fill, taking each colour in turn, the results obtained for the graphs plotted in the solid fill tests described above and shown in FIG. 3 are extrapolated to give an indication of a print speed at which the printer might be considered to be able to run "indefinitely" with acceptable nozzle firing quality. That extrapolated speed is then reduced by an amount to give the actual maximum acceptable continuous speed. For example, a factor is applied to the figure based on the amount of scatter obtained in the solid fill test results. For example, if a variation of +/−5% was seen in the solid fill tests, the extrapolated limit speed could be reduced by 5% to give an actual maximum continuous speed. FIG. 4 shows an example of the extrapolated maximum limit speed for a particular colour by taking the lowest limit speed of five tests (before being further reduced by a factor as described above to account for scatter).

Further determinations can be made as to maximum printing speed for different combinations of two and three colours, if these further tests have been carried out.

Step 2: Determination of Effect of Nozzle Utilization and Recovery Length Scale

In these tests, the effect of nozzle utilization on the nozzle firing quality is determined. Checkerboard patterns, corresponding to sections of solid fill or continuous firing of the nozzles and sections of no fill or no firing of the nozzles are run. Patterns having different lengths of fill and no fill are run so that a determination may be made of how different nozzle utilizations affect the nozzle firing quality or reliability at different printing speeds.

FIGS. 5*a* and 5*b* show examples of checkerboard patterns which are printed in these tests. Arrow P shows the direction of printing of the pattern. In FIG. 5*b*, the length of each cycle of fill and no fill is X; in FIG. 5*a*, the cycle length is X/2. For different parts of the checkerboard pattern, areas having a different proportion of fill and no fill are printed. For example, printing strips 51 and 51*a*, 80% of the length of the printed cycle comprises solid fill, corresponding to 80% equivalent fill. Strips 52 and 52*a* correspond to 60% equivalent fill and strips 53 and 53*a* correspond to 40% equivalent fill.

A series of checkerboard patterns is printed for each colour at different speeds as in step 1. Each test is repeated several times and a determination is made as to the length of print run without deterioration of the image quality for each % equivalent fill. The results are plotted as before, but using a normalised print speed. The normalised print speed is defined by:

Normalised Print Speed=(Actual Print Speed)×(Equivalent % fill)/100

The results are plotted for each equivalent % fill and length of cycle (X—see FIGS. 5*a* and 5*b*); FIG. 6 shows an example of a graph of the normalised print speed against length of run without deterioration of image for an equivalent 80% fill, where X (the length of the cycle) is 0.2 m. From this graph the extrapolated normalised print speed at which no deterioration can be expected can be determined (preferably scaled down using a safety factor as described above in Step 1).

Such tests are preferably carried out for several different combinations of % equivalent fill and different length scale, for example at three % equivalent fills and at four different length scales. As for Step 1, there will be a statistical fluctuation in the results so that several repetitions would preferably be carried out for each combination.

The results of these tests are then combined on a graph as shown in FIG. 7 to show the characteristic length scale over which the printheads can "recover" from the effect of high nozzle utilization printing.

The graph is plotted as the "normalised speed ratio" against length scale. The "normalised speed ratio" is defined by:

(Limit maximum speed at equivalent % fill and length scale)/(limit maximum speed at equivalent % continuous fill).

The limit maximum speed at 100% is that determined in step 1. The results are plotted for the different % fills tested.

The graph of FIG. 7 shows that when the length scale is short, such that a 100% fill image is closely followed by a 0% fill image, the printheads behave as though the image were simply printed at the average nozzle utilization. When the length scale is longer, the plotted results for the different % fill diverge, showing that it becomes harder to sustain the printing reliability of the nozzles over the length of the 100% part of the cycle.

This information can be taken into account when determining the optimum printing speed for printing a particular image.

Step 3: Analysis of Image for Printing and determination of Printing speed

Considering further the graph of FIG. 7, it can be seen that where the length scale is less than the recovery length scale, the actual % equivalent fill is unimportant. Thus an image can be "averaged" over the recovery length without it being required to consider closely the precise pattern of light and heavy fill.

The analysis of the image can therefore be carried out using the following method:

a) for each nozzle, determine the average % fill over lengths equal to the recovery length throughout the print run (assuming that the image repeats for the total run length). This averaging is preferably done at overlapping intervals of half the recovery length.

b) For each nozzle, determine the maximum average % fill over one recovery length, two recovery lengths, three recovery lengths, and so on up to the length of the entire print run.

c) Using the graph of FIG. 7, calculate a mathematical relationship (by formula, look-up table or other form) relating the normalised speed ratio to the length scale and the average % fill d) For each of the maximum average % fill calculated in step b), the maximum running speed for each of the groups can be calculated e) Determine the image printing speed as being the minimum of the running speeds calculated in step d).

The analysis of the image could be carried out by analysing the image data for the image to be printed, or could be carried out by printing a test of the image or a part of the image and analysing that. This latter option will, of course, generally only be worthwhile where that particular image (or similar images) are to be printed many times.

By carrying out these steps, it may be possible to increase the practical throughput of an inkjet printer significantly compared with one set up for a single print speed regardless of the image content.

While quite detailed analysis of the printer arrangement and image to be printed has been described, in many cases significant improvements may still be achieved by carrying out a very simple approximation of the key variables and attributes and their relationship to optimum nozzle firing frequency and hence printing speed.

For example, simply determining the average nozzle utilization over the whole image to be printed may give good enough information to determine a realistic optimum printing speed. Further, in many cases it can be assumed that the optimum speed is inversely proportional to the nozzle utilization, up to a certain top limit.

Ordering Images

In further examples, the order of printing images is determined to maximise overall printing speed.

In some examples, where several images are to be printed using a printer arrangement, the determination of optimum printing speed is carried out for each image in accordance with the example described above. Thus an optimum printing speed is determined for each image.

A further analysis is then carried out for the group of images to be printed. The queue of images to be printed is then created or adjusted so that the printing speed varies by the smallest possible steps between successive images. This is particularly useful, for instance, for a single-pass printer for which it takes time to change the line speed, but for which the images follow each other without a break.

In some cases, to reduce further the number of changes in speed required to print the group of images, the printing speed for some of the images may be adjusted (generally reduced) from the optimum calculated value so as to optimise the overall printing speed for printing the group of images, taking into account the potential reduction in time taken to change the printing speed between images.

Each feature disclosed in the description, and (where appropriate) the claims and drawings may be provided independently or in any appropriate combination.

The invention claimed is:

1. An apparatus for determining a printing speed for printing an image using an inkjet printer, the apparatus comprising, a printer comprising at least one nozzle for printing a test image at a plurality of different printing speeds;

an analysis device for determining information regarding a measure of the nozzle firing quality of the printer as a function of printing speed and in relation to an image attribute of the test image;

an input for receiving information regarding an image attribute of a further image to be printed, a storage device for storing information regarding a measure of the nozzle firing quality for the printer as a function of printing speed and the image attribute, and a processor adapted to use the image information and the measure of the nozzle firing quality in determining an optimum printing speed for printing the image.

2. A method of determining a printing speed for printing an image using an inkjet printer, the method comprising the steps of:

determining information regarding a measure of the nozzle firing quality of the printer as a function of printing speed and in relation to an image attribute by printing a test image at a plurality of different printing speeds, analyzing a further image to be printed in respect of the image attribute, and using the information regarding the measure of the nozzle firing quality to determine an optimum printing speed for printing the further image.

3. A method according to claim 2 wherein the optimum printing speed determined comprises a maximum printing speed for printing the further image.

4. A method according to claim 2, including the step of determining the information regarding the measure of the nozzle firing quality in respect of a printer arrangement to be used to print the further image.

5. A method according to claim 2, wherein the information regarding the measure of the nozzle firing quality includes information regarding a printing speed for printing a substantially full fill image, and/or wherein the information regarding the measure of the nozzle firing quality includes information relating to optimum printing speed for printing an image having less than full fill, and/or wherein the information regarding nozzle firing quality includes information relating to a plurality of different values for an average measure of nozzle utilization for the nozzles.

6. A method according to claim 2, wherein the step of determining information regarding a measure of the nozzle firing quality of the printer includes printing a further test image at a plurality of different printing speeds.

7. A method according to claim 2, further comprising determining a print recovery length.

8. A method according to claim 7, wherein sections of the further image are analysed separately and wherein the print length of the section is not more than the print recovery length.

9. A method according to claim 2, including identifying information relating to the print density of the further image to be printed, and/or wherein the method includes identifying information relating to the proportion of grid points to be printed.

10. A method according to claim 2, including determining a measure of nozzle utilization required for a nozzle of the printer to print the further image.

11. A method according to claim 2, wherein single printing speed is determined in respect of the printing of the image.

12. A method according to claim 2, wherein the method includes analysing a plurality of images to be printed; and using the information to determine printing instructions for printing the plurality of images, and the method further includes determining a printing speed for each of the images to be printed, and determining printing instructions for printing the plurality of images to increase the overall efficiency of printing the plurality of images.

13. A method according to claim 12 wherein increasing the overall efficiency comprises determining a printing order for the images to reduce changes in the printing speed between the printing of images.

14. A method according to claim 12 wherein increasing the overall efficiency comprises changing the printing speed determined for at least one image.

15. A method according to claim 14 wherein changing the printing speed comprises changing the speed to be closer to the determined speed for a preceding or following image.

16. A method according to claim 12 wherein the printing speed is determined based on an attribute of the image, and/or based on an attribute of the printer, and/or based on a measure of the nozzle firing quality, and/or based on information relating to the print density of the image.

17. A method according to claim 2, further comprising the step of printing the further image, wherein the printheads are substantially stationary during the printing of the further image.

18. A method according to claim 2 further comprising:

analysing the printed test images to determine the maximum printing speed for the printer to print the test image having a desirable nozzle firing quality.

19. A method according to claim 18, further including the step of printing an image including regions of solid fill and unprinted regions at a plurality of printing speeds.

20. A method according to claim 2 further comprising analyzing each of the printed test images to determine a measure of the nozzle firing quality of the printer at each of the different printing speeds.

21. A method according to claim 2 wherein the test image has an image attribute comprising an average nozzle utilization of the nozzles used to print the image.

22. A method according to claim 2 wherein the test image has a pattern of high nozzle utilization and low nozzle utilization.

23. A method of determining a printing speed for printing an image using an inkjet printer, the method comprising the steps of:

printing a plurality of test image areas at a plurality of different printing speeds, the test image areas each having a different nozzle utilization requirement;

obtaining a measure of reliability with which the nozzles function to eject droplets of ink for each test image area at each printing speed;

analyzing a further image to be printed to determine a measure of the nozzle utilization requirement of the further image; and using the information regarding the measure of reliability and the measure of nozzle utilization requirement of the further image to determine an optimum printing speed for reliably printing the further image.

24. The method of claim 23, wherein the optimum printing speed is a single printing speed.

25. The method of claim 23, further comprising analyzing a plurality of the further images to be printed to determine a measure of nozzle utilization requirement of each one of the further images to be printed;

determining an optimum printing speed for each one of the further images to be printed based on the measure of reliability and the measure of nozzle utilization requirement for each one of the further images to be printed; and identifying a printing order for the further images to be printed based on the optimum printing speed for each one of the further images to reduce changes in printing speed between printing of the further images and increase printing efficiency.

* * * * *